US009737997B1

(12) United States Patent
Marfione et al.

(10) Patent No.: US 9,737,997 B1
(45) Date of Patent: Aug. 22, 2017

(54) ROTATABLE SAFETY MECHANISM FOR AUTOMATIC FOLDING KNIFE

(71) Applicant: Marfione Custom Knives, LLC, Bradford, PA (US)

(72) Inventors: Anthony L. Marfione, Asheville, NC (US); David Reiser, West Springfield, PA (US)

(73) Assignee: Marfione Custom Knives, LLC, Bradford, PA (US)

( * ) Notice: Subject to any disclaimer, the term of this patent is extended or adjusted under 35 U.S.C. 154(b) by 92 days.

(21) Appl. No.: 14/292,383

(22) Filed: May 30, 2014

(51) Int. Cl.
*B26B 1/04* (2006.01)

(52) U.S. Cl.
CPC ..... *B26B 1/04* (2013.01)

(58) Field of Classification Search
CPC ..... B26B 1/048; B26B 1/042; B26B 1/044; B26B 1/046; B26B 1/04; Y10T 403/60
USPC ..... 30/153, 155, 156–158, 159, 160, 30/163–164; 292/50, 63, 69; 403/326–331, 322.1; 81/177.6, 177
See application file for complete search history.

(56) References Cited

U.S. PATENT DOCUMENTS

| | | | | |
|---|---|---|---|---|
| 1,752,463 | A * | 4/1930 | Smythe et al. | 70/195 |
| 4,240,201 | A * | 12/1980 | Sawby et al. | 30/161 |
| 7,237,463 | B1 * | 7/2007 | Lee | 81/177.8 |
| 8,646,184 | B2 * | 2/2014 | Westerfield | 30/155 |
| 2003/0182804 | A1 * | 10/2003 | Hawk | 30/155 |
| 2007/0169354 | A1 * | 7/2007 | Ralph | 30/160 |
| 2009/0193664 | A1 * | 8/2009 | Galyean | 30/161 |
| 2009/0245932 | A1 * | 10/2009 | Zhu et al. | 403/327 |

* cited by examiner

*Primary Examiner* — Stephen Choi
*Assistant Examiner* — Fernando Ayala
(74) *Attorney, Agent, or Firm* — The Van Winkle Law Firm; David M. Carter; William G. Heedy

(57) ABSTRACT

An automatic folding knife including a locking and safety mechanism. The locking and safety mechanism includes a radially outer surface on a blade attachment ring having an arcuate blade-open locking recess and an arcuate blade-closed locking recess circumferentially spaced from each other. A generally cylindrical lock ring is selectively axially movable into and out of engagement with the locking recesses so as to selectively lock the blade in either its open position or its closed position. A rotatable "safety" push button is provided to push the lock ring out of engagement. The rotatable push button can be rotated from its "active" position to a "safe" position regardless of whether the knife blade is open or closed.

3 Claims, 5 Drawing Sheets

ROTATABLE SAFETY MECHANISM FOR AUTOMATIC FOLDING KNIFE

BACKGROUND OF THE INVENTION

The invention relates generally to automatic folding (side-opening) knives and, more particularly, to safety mechanisms for such knives.

SUMMARY OF THE INVENTION

In one aspect, an automatic folding knife is provided. The automatic folding knife includes a handle having a butt end and a front end, and well as left and right handle halves defining an intermediate blade-receiving cavity. The knife includes a blade having an edge, a point end and an attachment end including a blade attachment ring pivotably attached to the handle near the attachment end so that the blade can pivot on a pivot axis between an open position in which the blade extends from the handle and a closed position in which at least the blade edge is received within the cavity, the blade attachment ring including a radially inner surface which is coaxial with the pivot axis and which serves as a pivot aperture. A torsion spring is connected to the handle and to the blade for urging the blade to pivot towards the open position. Also included is a locking and safety mechanism located generally along a safety mechanism axis spaced from and parallel to the pivot axis. The locking and safety mechanism in turn includes a radially outer surface on the blade attachment ring, the radially outer surface having an arcuate blade-open locking recess and an arcuate blade-closed locking recess circumferentially spaced from each other; a generally cylindrical lock ring selectively axially movable along the safety mechanism axis in a direction generally from within one of the handle halves into and out of engagement with the locking recesses so as to selectively lock the blade in either its open position or its closed position; a lock spring within the one of the handle halves urging the lock ring towards the blade attachment ring; a rotatable push button rotatable on the safety mechanism axis, the rotatable push button including a contact portion including a radially-extending interference portion located generally on the exterior of the other of the handle halves, and the rotatable push button including an actuating portion which extends along the safety mechanism axis from the contact portion so as to push the lock ring out of engagement with the locking recesses when the push button contact portion is pressed and axially moved; and an operating clearance recess within the other of the handle halves positioned so that the push button can be pressed and axially moved when the push button is rotated so that the push button interference portion is over the operating clearance recess, axial movement of the push button being prevented by engagement of the push button interference portion with the other of the handle halves when the push button is rotated so that the push button interference portion is not over the operating clearance recess.

DETAILED DESCRIPTION

Figure 1:
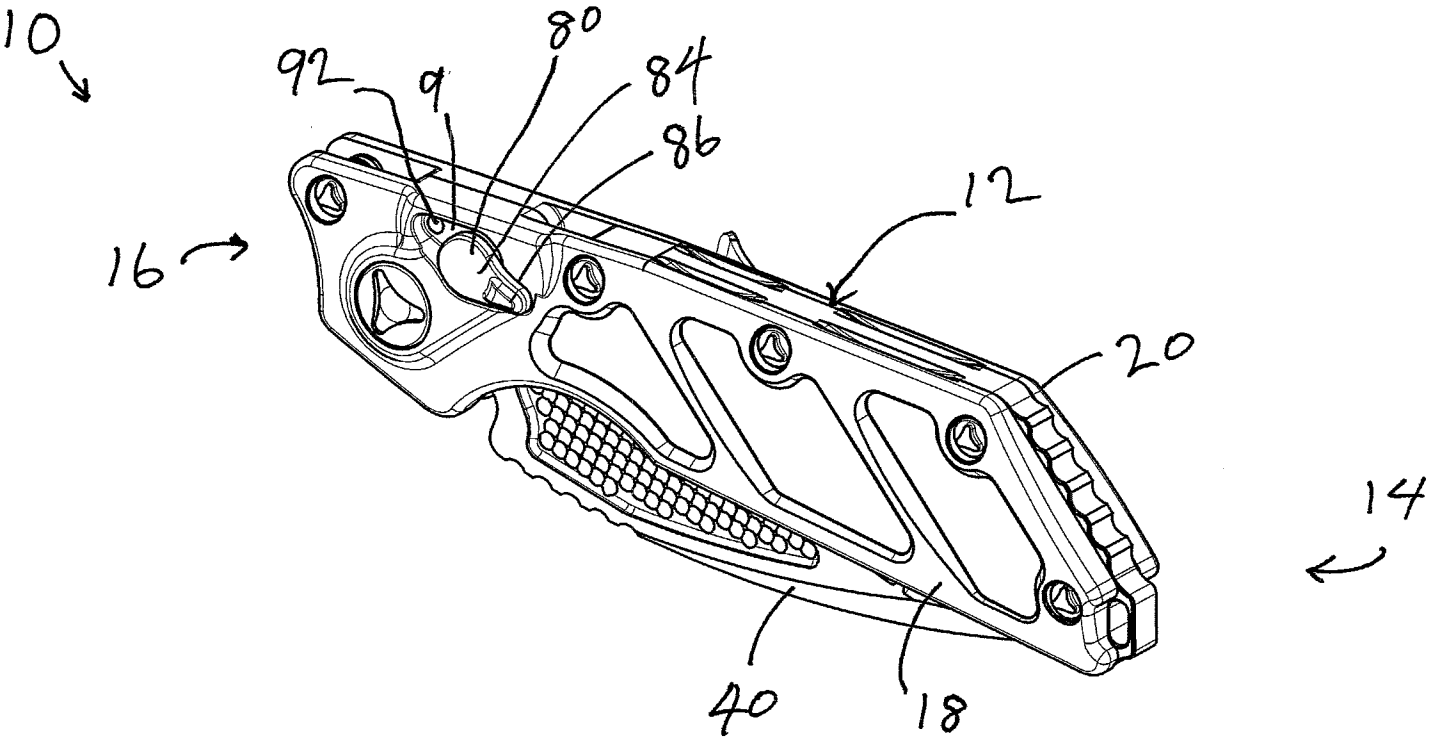
FIG. 1 is a three-dimensional view of an automatic folding knife embodying the invention, generally from the left side, with the blade in its closed position.
Figure 2:
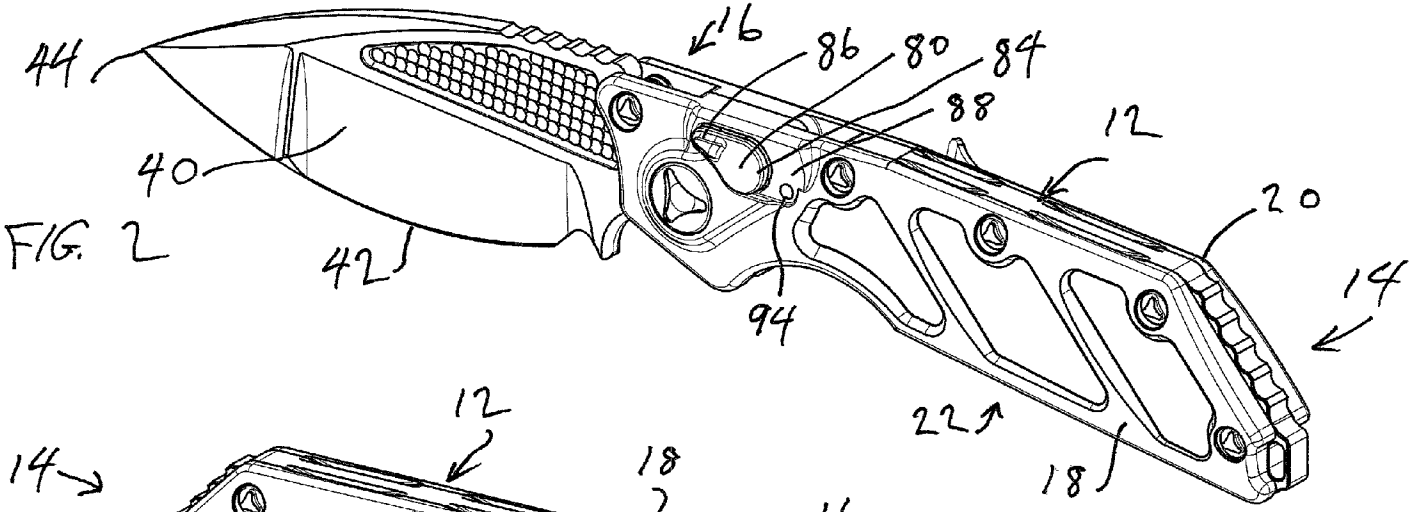
FIG. 2 is a three-dimensional view of the automatic folding knife in the same orientation as FIG. 1, also generally from the left side, but with the blade in its open position.
Figure 3:
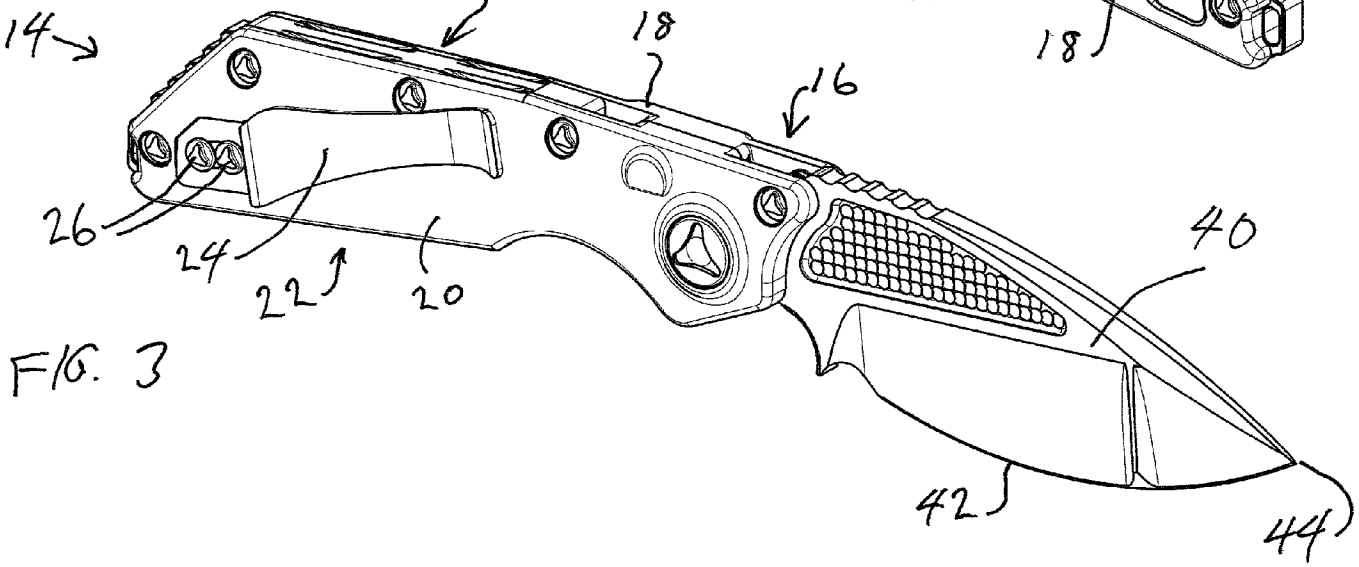
FIG. 3 is a three-dimensional view of the automatic folding knife embodying the invention, but generally from the right side, and with the blade in its open position as in FIG. 2.

Referring first to FIGS. 1-3, an automatic folding knife 10 embodying the invention is shown in its blade-closed position or configuration (FIG. 1) and in its blade-open position or configuration (FIGS. 2 and 3). The knife 10 includes a handle 12. The handle has a butt end 14 and a front end 16, with left and right handle halves 18 and 20 defining an intermediate blade-receiving cavity 22, in a generally conventional construction as thus far described. Mounted to the right handle half 20 is a pocket clip 24, secured by two screws 26.

The left and right handle halves 18 and 20 more particularly are located in spaced relationship to each other to define the blade-receiving cavity 22 by a back spacer 28 having four threaded apertures 30 on its left side (FIG. 4) and four threaded apertures 32 on its right side (FIG. 5) which receive left side handle securing screws 34 and right side handle securing screws 36.

The automatic folding knife 10 also includes a blade 40 having an edge 42, a point end 44 and an attachment end 46.

Figure 4:
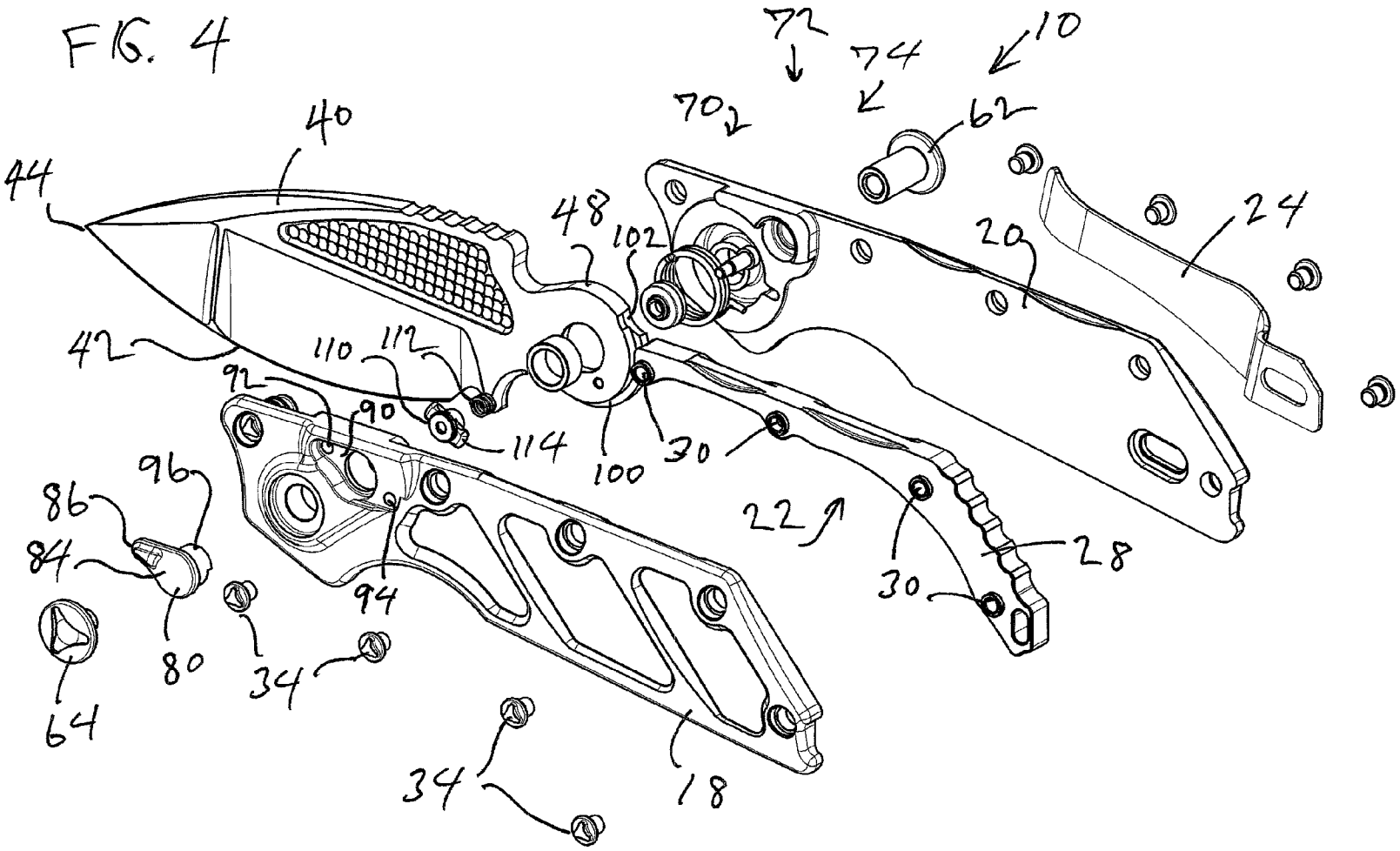
FIG. 4 is an exploded view corresponding to FIG. 2.
Figure 5:
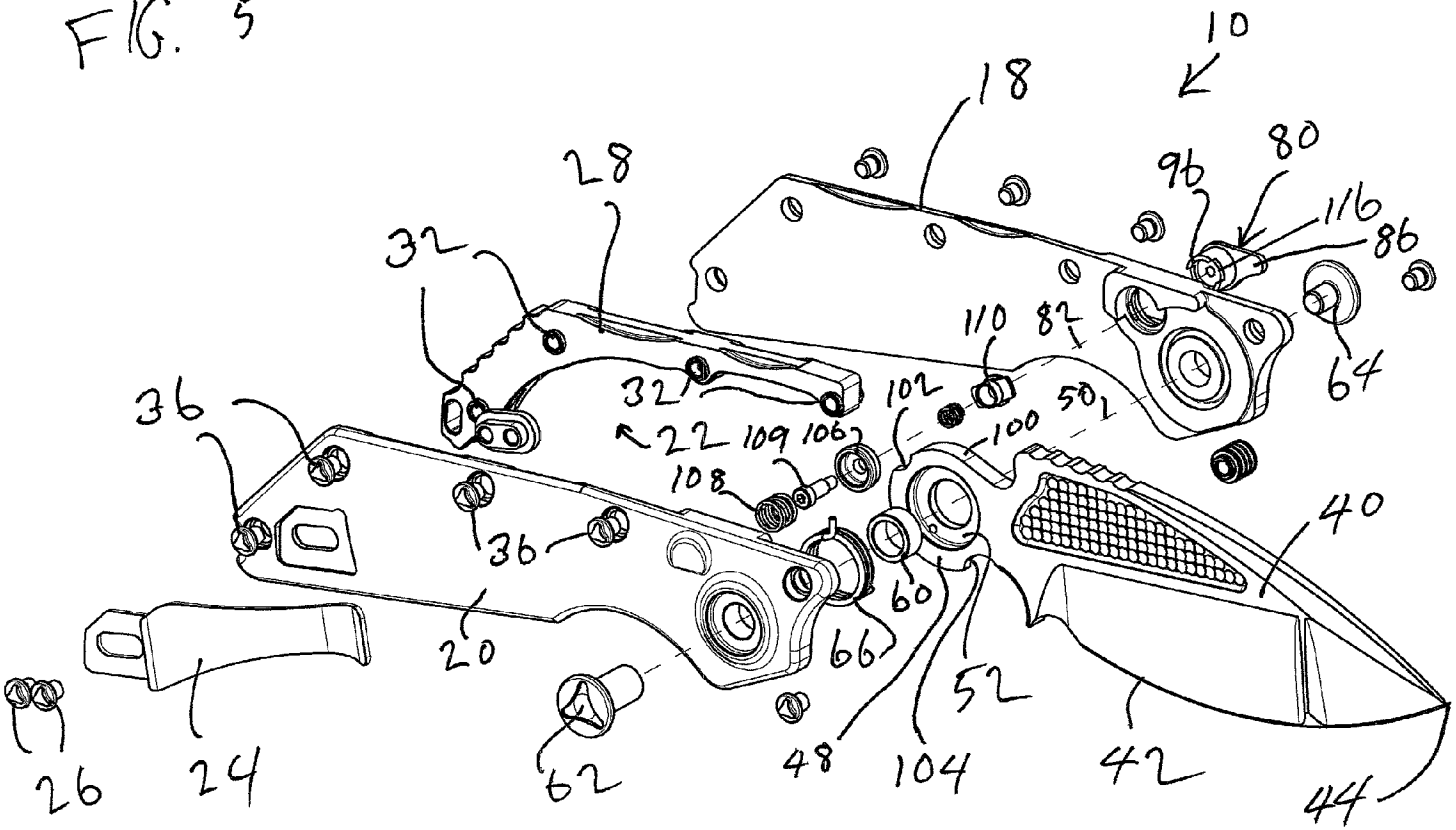
FIG. 5 is an exploded view corresponding to FIG. 3.
Figure 6:
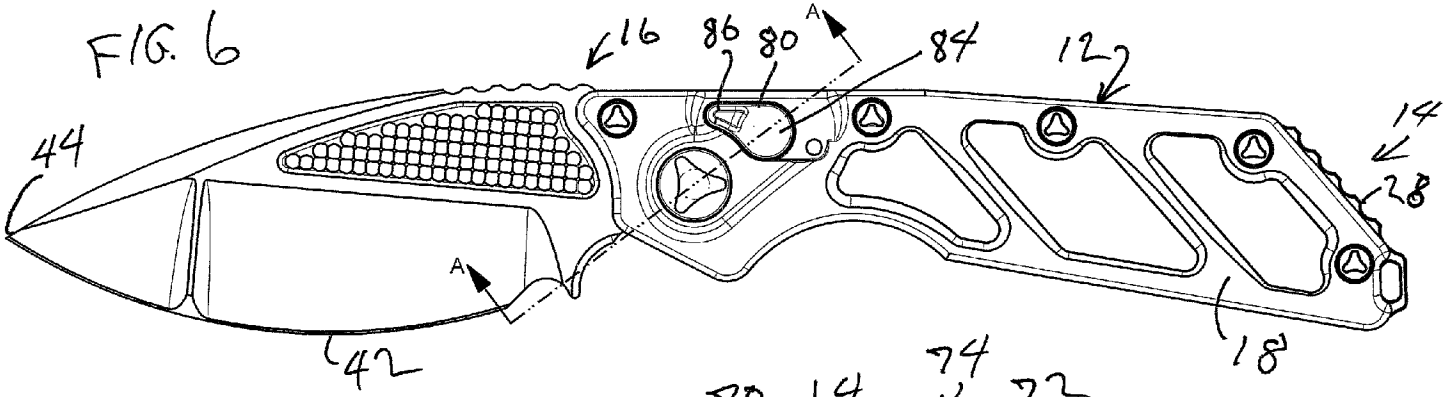
FIG. 6 is a side elevational view of the left side of the automatic folding knife embodying the invention, corresponding generally to FIG. 2.

Referring also to the exploded views of FIGS. 4 and 5, in addition to the three-dimensional views of FIGS. 1-3, the blade 40, at its attachment end 46, includes a blade attachment ring 48. The blade 40 pivots on a pivot axis 50 between the open position of FIGS. 2-6 in which the blade 40 extends from the handle 12, and a closed position (FIG. 1) in which at least the blade edge 42 is received within the cavity 22. The blade attachment ring 48 includes a radially inner surface 52 which is coaxial with the pivot axis 50 and which serves as a pivot aperture.

Figure 7:
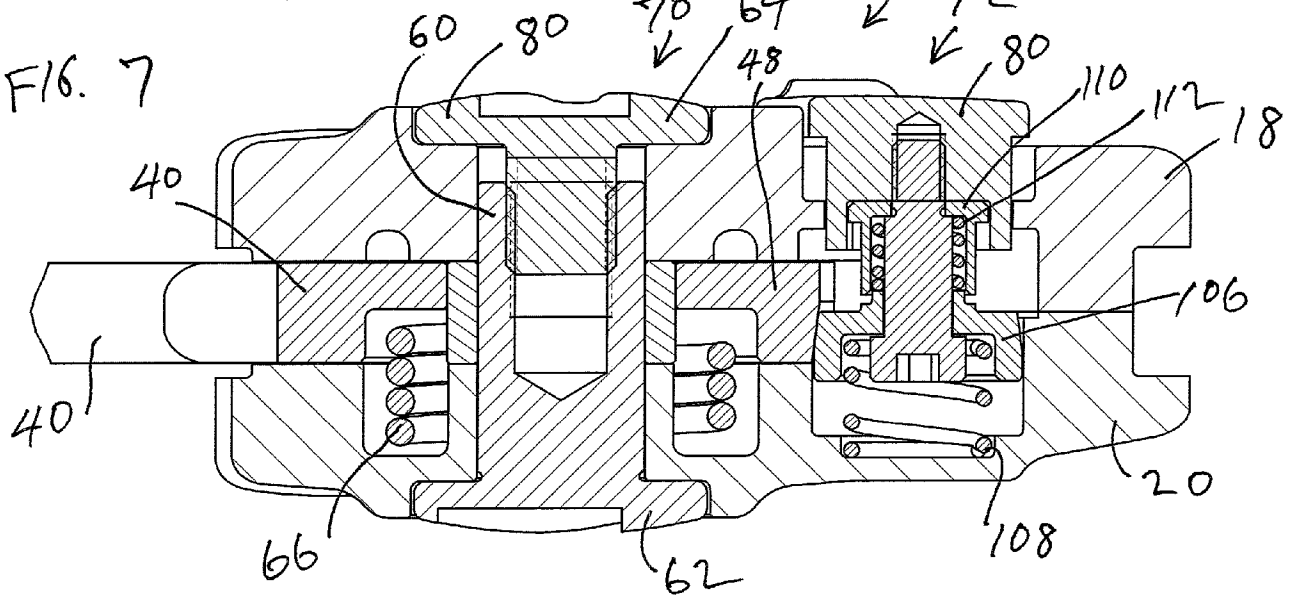
FIG. 7 is a cross-sectional view taken on line A-A of FIG. 6.

With particular reference to the exploded detail of FIGS. 4 and 5, and the cross sectional view of FIG. 7, to facilitate pivoting of the blade 40, a blade bushing 60 is provided, as well as a pair of pivot screws, a female pivot screw 62 extending from the right side and through an aperture in the right handle half 20, and a male pivot screw 64 extending from the left side and through an aperture in the left handle half 18.

Since the knife 10 is an automatic knife, a torsion spring 66 (FIGS. 4, 5 and 7) is connected to the handle 12 and to the blade 40 for urging the blade 40 to pivot towards the open position of FIGS. 2-6.

For selectively holding the blade 40 in either its closed position of FIG. 1 or its open position of FIGS. 2-6, a locking mechanism, generally designated 70, is provided, and described in greater detail hereinbelow. In addition, there is a safety mechanism, generally designated 72, and also described in greater detail hereinbelow, which controls operation of the locking mechanism 70. The locking mechanism 70 and the safety mechanism 72 are also herein together referred to as a locking and safety mechanism, generally designated 74.

The safety mechanism 72 includes a rotatable push button 80 rotatable on a safety mechanism axis 82 (FIG. 5). The rotatable push button 80 includes a contact portion 84 including a radially-extending interference portion 86 located generally on the exterior of the left handle half 18, and visible particularly in FIGS. 1 and 2. The contact portion 84 and included interference portion 86 are manipulable by the thumb of a user. Thus, the contact portion 84 and interference portion 86 can be rotated between a "safe" position as illustrated in FIG. 1, and an "active" position as in FIG. 2. In addition, in the "active" position of FIG. 2, the contact and interference portions 84 and 86 of the push button 80 can be pressed and thus axially moved on the safety mechanism axis 82.

Thus, as shown in FIG. 4, the left handle half 18 includes land portion 88 which the push button 80 interference portion 86 overlies in the "safe" position, to prevent pushing the button 80. The handle half 18 also has an operating clearance recess 90 which receives the push button 80 interference portion 86, allowing the button 80 to be depressed in the "active" position.

Colored indicia dots are either covered or revealed depending upon the position of the interference portion 86. In the "safe" configuration of FIG. 1, a "safe" indicia dot 92 is visible. Conversely, in the "active" configuration of FIG. 2, an "active" indicia dot 94 is visible. (Both indicia dots 92 and 94 are visible in the exploded view of FIG. 4.) Preferably, the indicia dots 92 and 94 are of different colors, such as white and red, as a matter of design preference.

An important characteristic of embodiments of the invention is that the rotatable push button 80 can be rotated to the "safe" position of FIG. 1 regardless of whether the blade 40 is open or closed. Thus, although, in FIGS. 2 and 3, the contact and interference portions 84 and 86 of the rotatable push button 80 are illustrated in the "active" position, the rotatable push button 80 can be rotated to the "safe" position positively locking the blade 40 in its open position.

In addition, the rotatable push button 80 is in general recessed so that the surface of the rotatable push button 80 is generally flush with the handle left side 18 to minimize the possibility of inadvertent movement of the push button 80.

The rotatable push button 80 additionally includes an actuating portion 96, visible in FIGS. 4, 5 and 7.

As part of the locking and safety mechanism 74, and more particularly the locking mechanism 70 portion thereof, the blade attachment ring 48 includes a radially outer surface 100 having an arcuate blade-open locking recess 102 and an arcuate blade-closed locking recess 104. The blade-open locking recess 102 and the blade-closed locking recess 104 are circumferentially spaced from each other.

Selectively engaging the locking recesses 102 and 104 is a generally cylindrical lock ring 106 selectively axially movable along the safety mechanism axis 82 in a direction generally within the right handle half 20 into and out of engagement with the locking recesses 102 and 104 so as to selectively lock the blade 40 in either its open position (FIGS. 1 and 3) or its closed position (FIG. 1).

The lock ring 106 is urged by a lock spring 108 within the right handle half 20 towards the blade attachment ring 48 and, more particularly, towards the locking recesses and 102 and 104. A lock screw 109 secures the lock ring 106.

Preferably, the locking recesses 102 and 104 and the lock ring 106 have radially tapered surfaces (visible in the cross-sectional view of FIG. 7) for wedging engagement. The taper allows the lock to "wedge in" and prevent the blade 40 from moving at all. If the taper were not included, clearance would be required to allow the lock to engage, which undesirably would allow slight movement of the blade 40. In other words, the wedging taper lock creates a positive lock, preventing any movement of the blade 40 when locked in either the closed position or configuration of FIG. 1 of the open configuration of FIGS. 2-6.

To provide a "click in" detent when the rotatable push button 80 is rotated with its interference portion 86 pointing either back towards to the butt end 14 of the handle as in FIG. 1 (the "safe" position) or forward towards the front end 16 of the handle as in FIG. 2 (the "active" position), an axially-floating detent 110 is provided, generally within the left handle half 18. A detent spring 112 is located intermediate the actuating portion 96 of the push button 80 and the lock ring 106. The detent spring 112 urges the detent 110 away from the lock ring 106. The detent 110 rotates with the button 80 and has a pair of wings 114 which engage a pair of orientation slots 116 on the rotatable push button 80.

To allow the detent 110 to actuate correctly, and to allow the push button 80 to rotate with the lock engaged, spacing is provided such that approximately 0.015 inch of "lost motion" travel occurs before pressing movement of the push button 80 begins to move the lock ring 106.

Again, an important characteristic of embodiments of the invention is that the rotatable push button 80 can be rotated to the "safe" position of FIG. 1 regardless of whether the blade 40 is open or closed. In the "safe" position of FIG. 1, the push button 80 cannot be pressed (due to the interference portion 86 overlying the land portion 88 of the handle) and the lock ring 106 remains engaged with either the blade-open locking recess 102 or the blade-closed locking recess 104.

When the push button 80 is rotated to the "active" position of FIG. 2, the interference portion 86 is over the operating clearance recess 90, allowing the push button 80 to be pressed, allowing the actuating portion 96 of the push button to radially move, along with the detent 110, disengaging the lock ring 106 from either the blade-open locking recess 102 or the blade closed locking recess 104.

While a specific embodiment of the invention has been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. An automatic folding knife, comprising:

a handle having a butt end and a front end, and including left and right handle halves defining an intermediate blade receiving cavity;

a blade having an edge, a point end and an attachment end including a blade attachment ring pivotably attached to said handle near said attachment end so that said blade can pivot on a pivot axis between an open position in which said blade extends from said handle and a closed position in which at least said blade edge is received within said cavity, said blade attachment ring including a radially inner surface which is coaxial with the pivot axis and which serves as a pivot aperture;

a torsion spring connected to said handle and to said blade for urging said blade to pivot towards the open position;

a locking and safety mechanism located along a safety mechanism axis spaced from and parallel to the pivot axis, said locking and safety mechanism including:

a radially outer surface on said blade attachment ring, said radially outer surface having an arcuate blade open locking recess and an arcuate blade closed locking recess circumferentially spaced from each other, a cylindrical lock ring selectively axially movable along the safety mechanism axis in a direction from within one of said handle halves into and out of engagement with said locking recesses so as to selectively lock said blade in either its open position or its closed position, a lock spring within said one of said handle halves urging said lock ring towards said blade attachment ring, a rotatable push button rotatable on the safety mechanism axis, said rotatable push button including a contact portion including a radially extending interference portion located on the exterior of the other of said handle halves, and said rotatable push button including an actuating portion which extends along the safety mechanism axis from said contact portion so as to push said lock ring out of engagement with said locking recesses when said push button contact portion is pressed and axially moved, and an operating clearance recess within said other of said handle halves positioned so that said push button can be pressed and axially moved when said push button is rotated so that said push button interference portion is over said operating clearance recess, axial movement of said push button being prevented by engagement of said push button interference portion with said other of said handle halves when said push button is rotated so that said push button interference portion is not over said operating clearance recess;

a detent in abutment with a detent spring each within said other of said handle halves intermediate said actuating portion of said rotatable push button and said lock ring, said detent having a pair of wings extending outwardly therefrom, and said detent spring being structured and disposed for urging said detent away from said lock ring; and wherein said pair of wings is in engaged abutment with said rotatable push button thereby causing said detent to rotate with said rotatable push button.

2. The automatic folding knife of claim 1, wherein said locking recesses and said lock ring have radially tapered surfaces for wedging engagement.

3. The automatic folding knife of claim 1, wherein spacing is provided between said rotatable push button and said lock ring for allowing said rotatable push button to rotate when said cylindrical lock ring is in engagement with said locking recesses.

* * * * *